US007495535B2

(12) United States Patent
Mikl

(10) Patent No.: US 7,495,535 B2
(45) Date of Patent: Feb. 24, 2009

(54) MAGNET SYSTEM WITH H-SHAPED ARMATURE FOR A RELAY

(75) Inventor: Rudolf Mikl, Arbesthal (AT)

(73) Assignee: Tyco Electronics Austria GmbH, Vienna (AT)

( * ) Notice: Subject to any disclaimer, the term of this patent is extended or adjusted under 35 U.S.C. 154(b) by 87 days.

(21) Appl. No.: 11/690,160

(22) Filed: Mar. 23, 2007

(65) Prior Publication Data

US 2007/0229203 A1 Oct. 4, 2007

(30) Foreign Application Priority Data

Mar. 30, 2006 (DE) ..... 10 2006 015 251

(51) Int. Cl.
*H01H 51/22* (2006.01)

(52) U.S. Cl. ..... 335/78; 335/84; 335/85; 335/179; 335/229; 335/234; 335/276

(58) Field of Classification Search ..... 335/78–85, 335/179, 229–234, 276
See application file for complete search history.

(56) References Cited

U.S. PATENT DOCUMENTS 4,707,675 A * 11/1987 Motoyama et al. ..... 335/130

FOREIGN PATENT DOCUMENTS

| | | | |
|---|---|---|---|
| DE | 24 07 184 | A1 | 8/1975 |
| DE | 93 20 696 | U1 | 1/1995 |
| DE | 197 15 261 | C1 | 12/1998 |
| DE | 198 47 831 | A1 | 8/2001 |
| EP | 0 038 727 | A1 | 10/1981 |
| EP | 0 234 454 | A1 | 9/1987 |
| EP | 1 244 127 | A2 | 9/2002 |
| EP | 1 455 372 | B1 | 9/2004 |

OTHER PUBLICATIONS

European Search Report dated Nov. 14, 2007 for Application No. EP 07 00 5108.

* cited by examiner

*Primary Examiner*—Ramon M Barrera
(74) *Attorney, Agent, or Firm*—Barley Snyder LLC

(57) ABSTRACT

A magnet system for a bi-stable relay includes a coil, first and second core yoke members, and an armature. The coil has a first polarity state and a second polarity state. Each of the first and second core yoke members has a core arm and a yoke arm. Each of the yoke arms of the first and second core yoke members has a pole face. The armature has substantially parallel armature core arms separated by a permanent magnet. The armature is pivotally mounted in an air gap between the pole faces of the yoke arms of the first and second core yoke members such that the armature core arms contact the yoke arms in a first switch position corresponding to the first polarity state and in a second switch position corresponding to the second polarity state. The armature core arms are arranged substantially perpendicular to a center axis of the coil.

18 Claims, 6 Drawing Sheets

MAGNET SYSTEM WITH H-SHAPED ARMATURE FOR A RELAY

CROSS-REFERENCE TO RELATED APPLICATIONS

This application claims the benefit of the filing date under 35 U.S.C. § 119(a)-(d) of German Patent Application No. DE 10 2006 015 251.4, filed Mar. 30, 2006.

FIELD OF THE INVENTION

The invention relates to a magnet system for a bi-stable relay comprising a coil arranged substantially horizontally within an insulating body of the relay and an armature that is pivotable between a first switch position and a second switch position depending on whether the magnet system is in a first or second polarity state.

BACKGROUND

Examples of magnet systems or relays with armatures having a substantially H-shape are shown in DE 197 15 261 C1 and DE 93 20 696 U1. These relays can alternate between two stable switch positions by reversing polarity of the magnet system. The magnet system provides force for both switch directions so that a force is applied to contact carriers of the relay not only during movement to a closed position but also on movement to an open position. This is advantageous in particular in connection with the breaking open of welds occurring in the course of the electrical life of the relay.

Examples of relays having a slider arranged parallel to a bottom surface (datum plane) of a body of the relay that transmits movement of an armature having a shape other than an H-shape to a contact system of the relay are shown in EP 1 244 127 A2 and DE 198 47 831 A1. These relays use a conventional magnet system with a hinged armature located at a front of a coil that is positioned horizontally within the body. An armature core arm located perpendicular to the bottom surface of the body and the slider is thereby effectively connected to the slider. The armature core arm has an armature projection that engages a recess of the slider so that the pull-up or opening movement of an armature plate is directly converted into a horizontal reciprocating movement of the slider. Because the coil is arranged horizontally within the body and thus parallel to the bottom surface, the height of the relay is small.

It is known for the above-described relay containing the horizontal slider to be fitted with the generic polarity-reversible magnet system with an H-shaped armature. However, thus far this combination of elements could only be realized by arranging the coil vertically within the body. As a result of the arrangement of the coil vertically within the body, the overall height of the relay is large. For example, a relay with a horizontally arranged coil typically has an overall height of 16 mm where a relay with a vertically arranged coil typically has an overall height of 30 mm.

FIGS. 1-2 show an example of a magnet system for a relay according to the prior art. As shown in FIGS. 1-2, a coil (bobbin core) 18' is vertically arranged within the magnet system such that the coil 18' is perpendicular to a slider 19'. When the magnet system is arranged in the relay, the coil 18' is therefore positioned perpendicular to a bottom surface of a body of the relay. A core construction of the magnet system consists of first and second core yoke members 1', 2' having yoke arms 5', 6' and core arms 3', 4', respectively. The first and second core yoke members 1', 2' each deviate from a typical straight L-shape in that the yoke arms 5', 6' are each turned inwardly to form opposing pole faces 10', 11', which are separated by an air gap 16'. Thus, each of the yoke arms 5', 6' are L-shaped, and each of the core arms 3', 4' are straight. An armature 7' having an H-shape is arranged between the yoke arms 5', 6' and parallel to a center axis of the coil 18' so that the slider 19' is movable in a direction horizontal to the bottom surface of the body of the relay by an armature projection 20'. The armature 7' described herein is only compatible with a magnet system wherein the coil 18' is positioned perpendicular to the bottom surface of the body of the relay. Thus, the relay has a large overall height.

BRIEF SUMMARY

It is therefore an object of the invention to provide a magnet system with first and second switch positions that has a low overall height.

This and other objects are achieved by a magnet system for a relay comprising a coil, first and second core yoke members, and an armature. The coil has a first polarity state and a second polarity state. Each of the first and second core yoke members has a core arm and a yoke arm. Each of the yoke arms of the first and second core yoke members has a pole face. The armature has substantially parallel armature core arms separated by a permanent magnet. The armature is pivotally mounted in an air gap between the pole faces of the yoke arms of the first and second core yoke members such that the armature core arms contact the yoke arms of the first and second core yoke members in a first switch position corresponding to the first polarity state and in a second switch position corresponding to the second polarity state. The armature core arms are arranged substantially perpendicular to a center axis of the coil.

This and other objects are further achieved by a relay comprising an insulating body, a coil, first and second core yoke members, and an armature. The insulating body has a bottom surface and a recess. The coil has a first polarity state and a second polarity state. The coil is arranged in the recess such that a center axis of the coil is arranged substantially parallel to the bottom surface. Each of the first and second core yoke members has a core arm and a yoke arm. Each of the yoke arms has a pole face. The armature has substantially parallel armature core arms separated by a permanent magnet. The armature is pivotally mounted in an air gap between the pole faces of the yoke arms of the first and second core yoke members such that the armature core arms contact the yoke arms of the first and second core yoke members in a first switch position corresponding to the first polarity state and in a second switch position corresponding to the second polarity state.

DETAILED DESCRIPTION OF THE EMBODIMENT(S)

Figure 1:
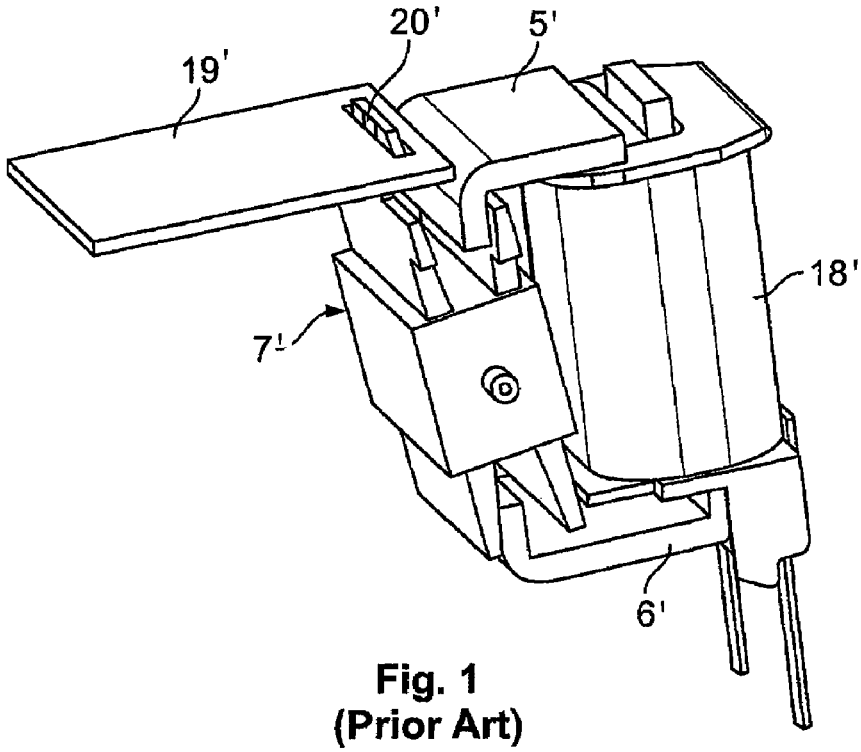
Fig. 1 (Prior Art)
FIG. 1 is a diagrammatic perspective view of a magnet system for a relay according to the prior art.
Figure 2:
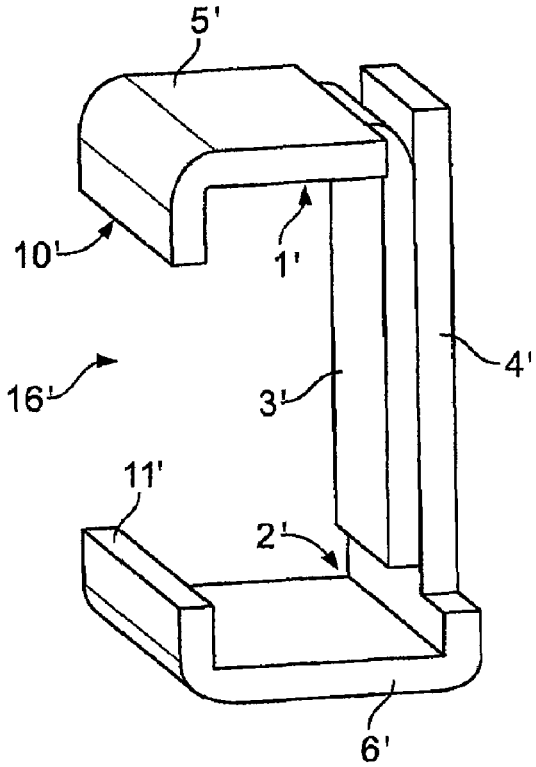
Fig. 2 (Prior Art)
FIG. 2 is a diagrammatic perspective view of a yoke core member of the magnet system of FIG. 1.
Figure 3:
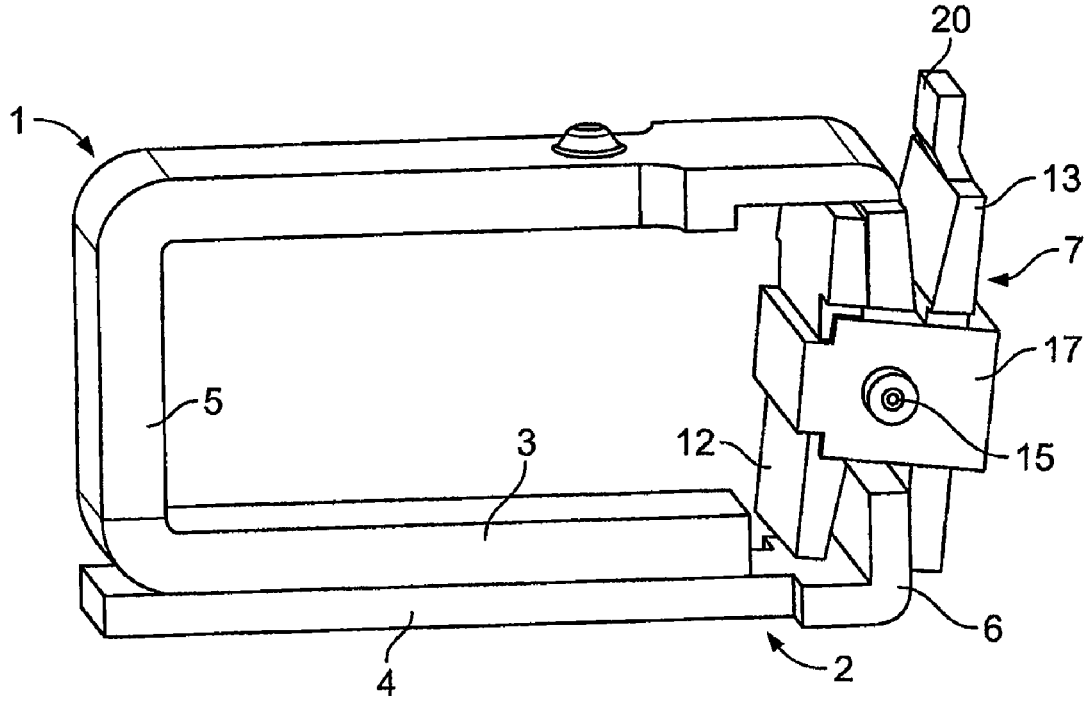
FIG. 3 is a diagrammatic perspective view of a core structure of a magnet system according to the invention.
Figure 4:
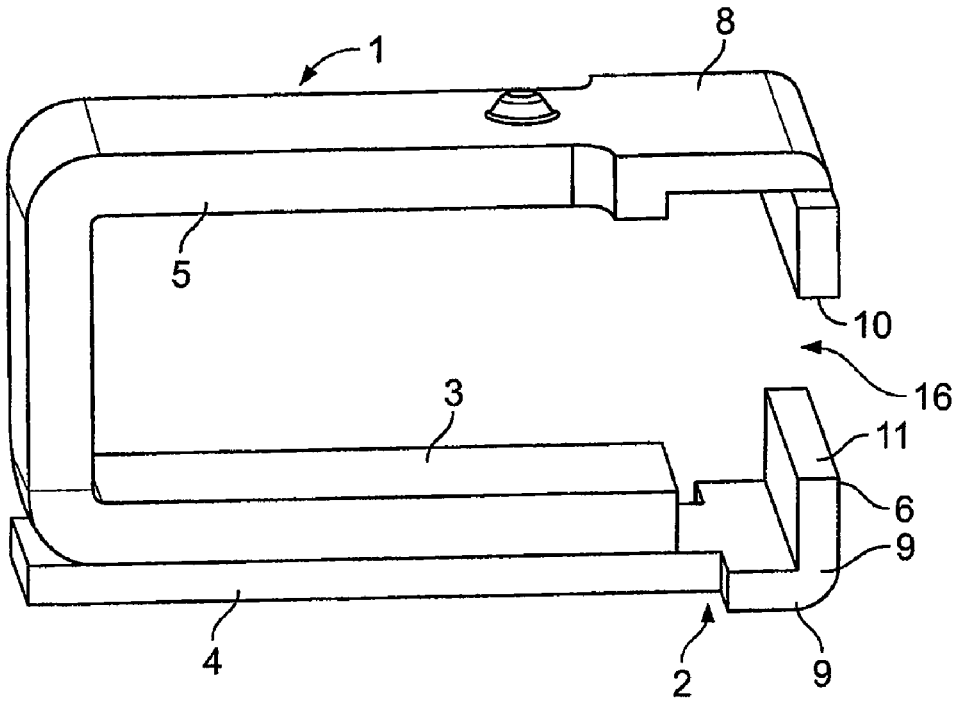
FIG. 4 is a diagrammatic perspective view of a yoke core member of the core structure of FIG. 3.
Figure 8:
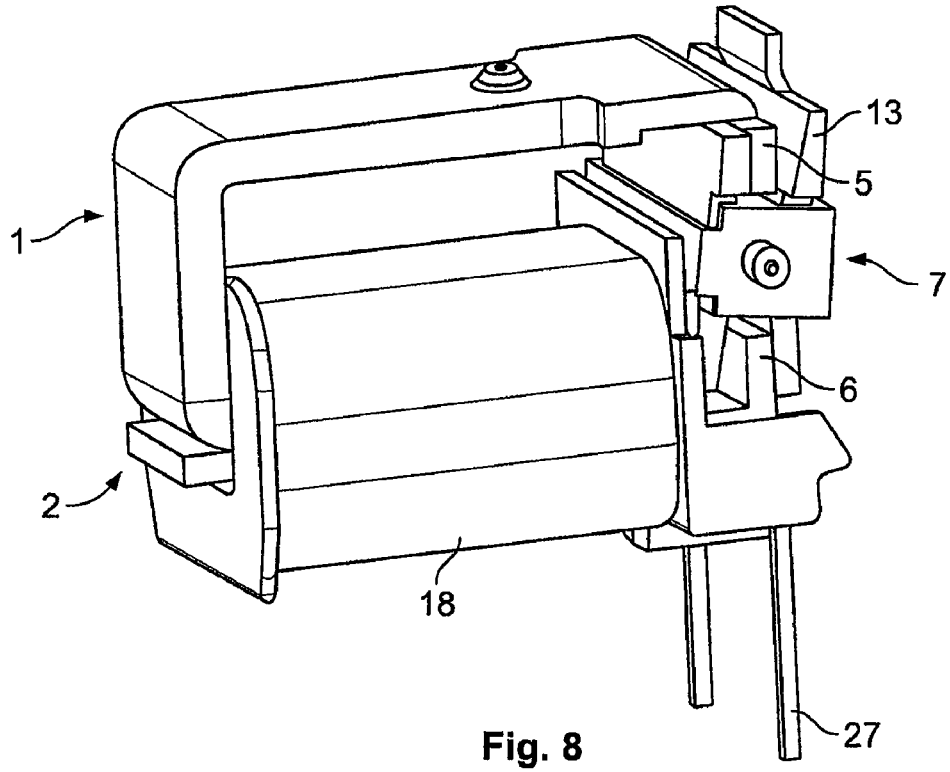
FIG. 8 is a diagrammatic perspective view of the magnet system of FIG. 3.

FIG. 8 shows a magnet system for a bi-stable relay according to the invention. As shown in FIG. 8, the magnet system comprises a core structure consisting of a first core yoke member 1, a second core yoke member 2, and an armature 7 having a substantially H-shape. As shown in FIGS. 3-4, the first core yoke member 1 has a core arm 3 and a yoke arm 5. The first core yoke member 1 is configured to have a substantially U-shape. The yoke arm 5 of the first core yoke member 1 has a first portion extending from and substantially perpendicular to the core arm 3 of the first core yoke member 1, a second portion extending from and substantially perpendicular to the first section and substantially parallel to the core arm 3 of the first core yoke member 1, and a third section extending from and substantially perpendicular to the second section and substantially perpendicular to the core arm 3. A free end of the yoke arm 5 of the first core yoke member 1 has a pole face 10. An end section 8 of the free end of the yoke arm 5 of the first core yoke member 1 is enlarged in cross-section toward the pole face 10 so that the narrower core arm 3 can easily be accommodated in a coil (bobbin core) 18 (FIG. 8) of the magnet system and the pole face 10 is large for the armature 7.

As shown in FIGS. 3-4, the second core yoke member 2 has a core arm 4 and a yoke arm 6. The second core yoke member 2 is substantially L-shaped. The yoke arm 6 of the second core yoke member 2 extends from and substantially perpendicular to the core arm 4 of the second core yoke member 2. A free end of the yoke arm 6 of the second core yoke member 2 has a pole face 11. End sections 9 of the yoke arm 6 and the core arm 4 of the second core yoke member 2 are enlarged in cross-section toward the pole face 11 so that the narrow portion of the core arm 4 can easily be accommodated in the coil 18 (FIG. 8) of the magnet system and the pole face 11 is large for the armature 7. The core arm 3 of the first core yoke member 1 is supported on the core arm 4 of the second core yoke member 2 so that the pole face 10 of the first core yoke member 1 and the pole face 11 of the second core yoke member 2 oppose each other and an air gap 16 is formed there between.

Figure 5:
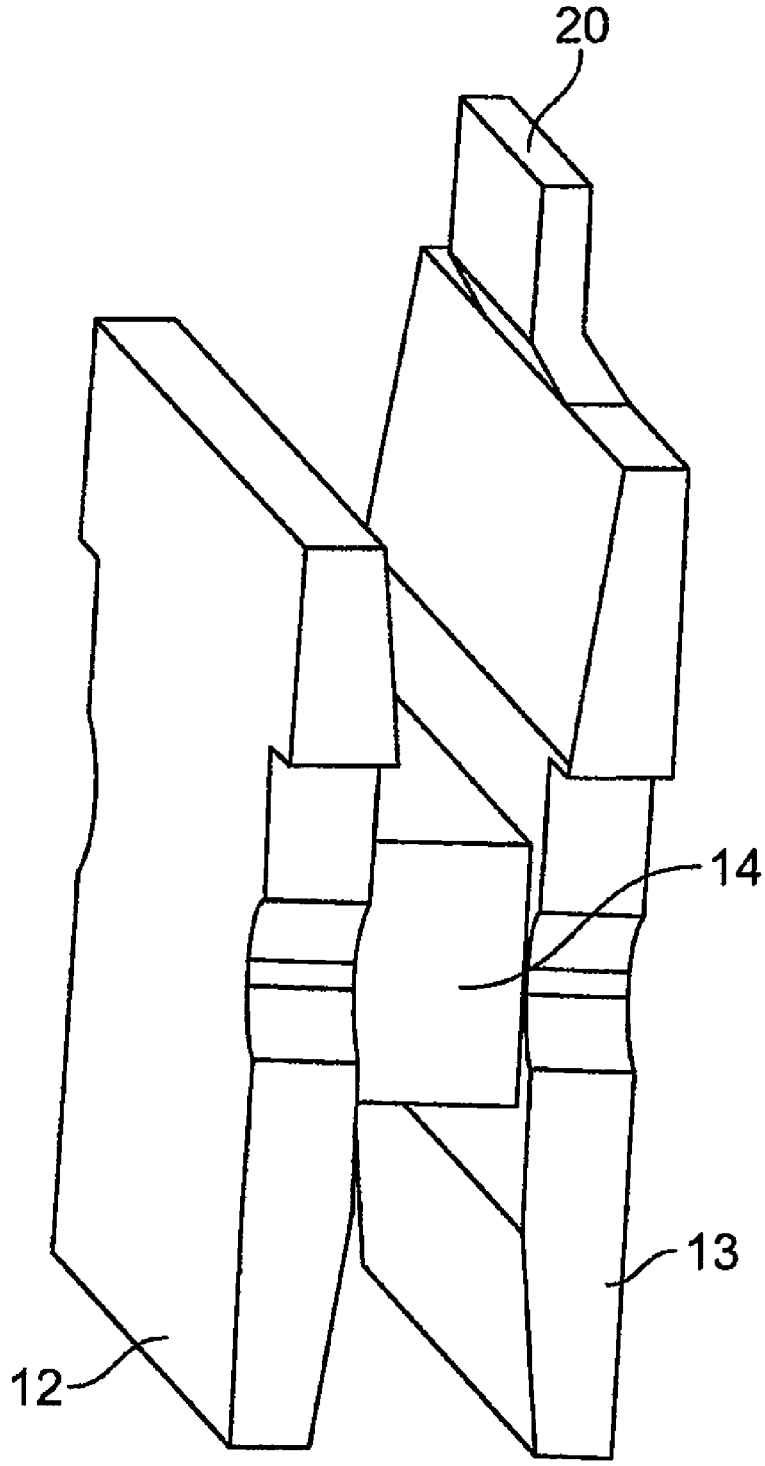
FIG. 5 is a diagrammatic perspective view of an armature having a substantially H-shape of the core structure of FIG. 3.
Figure 6:
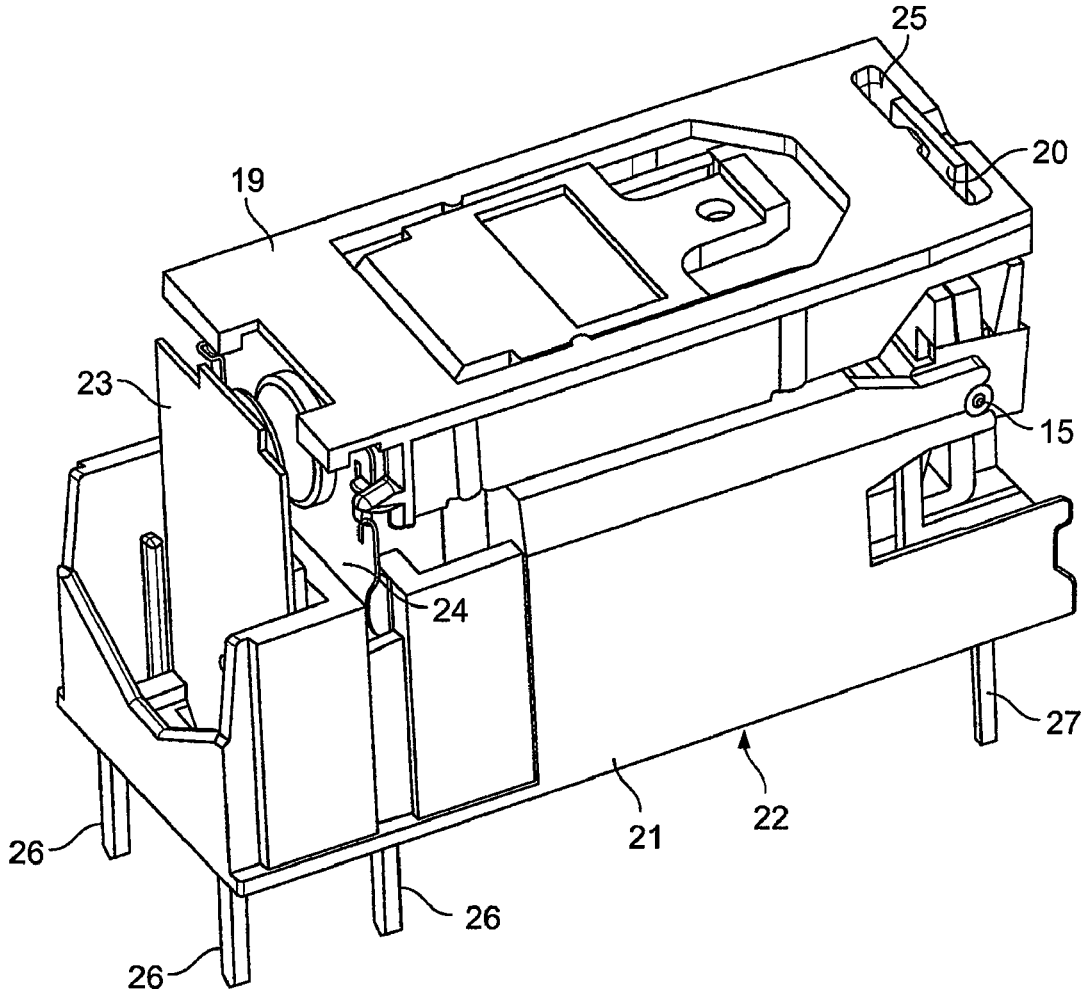
FIG. 6 is a diagrammatic perspective view of a bi-stable relay containing the core structure of FIG. 3.
Figure 7:
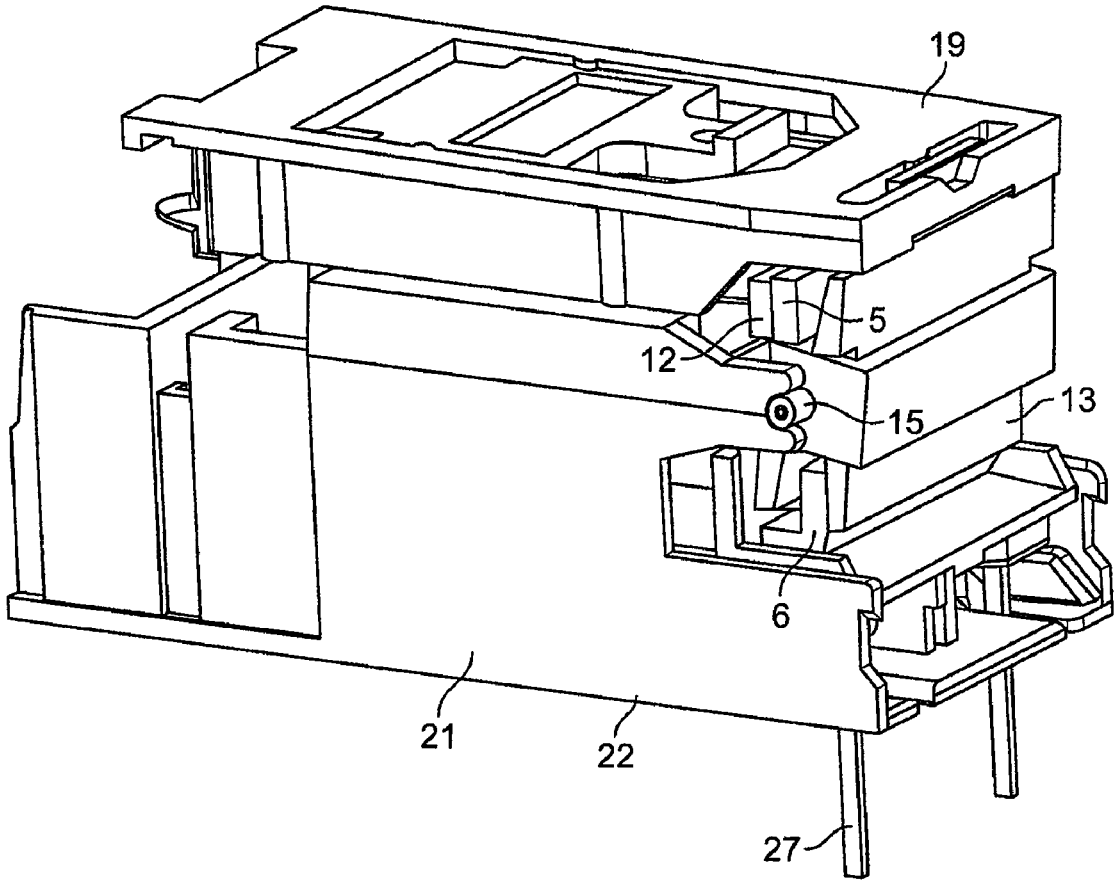
FIG. 7 is another diagrammatic perspective view of the bi-stable relay containing the core structure of FIG. 3.

As shown in FIG. 5, the armature 7 is substantially H-shaped and consists of a pair of substantially parallel armature core arms 12, 13 connected by a permanent magnet 14. As shown in FIG. 3, the armature 7 can be provided with a plastic extrusion coating 17 in an approximate center thereof. Stub axles 15 are provided on sides of the plastic extrusion coating 17 and are integrally formed therewith. The stub axles 15 are configured such that the armature 7 may be pivoted when mounted on a body 21 (FIGS. 6-7). An actuation projection extends from a free end of the armature core arm 13.

As shown in FIG. 3, to form the core structure, the permanent magnet 14 of the armature 7 is arranged in the air gap 16 between the pole faces 10, 11 of the first and second core yoke members 1, 2 such that the armature core arms 12, 13 are arranged on opposite sides of the yoke arms 5, 6 of the first and second core yoke members 1, 2. As shown in FIG. 8, to form the magnet system, the core structure is mounted to the coil 18 such that the core yoke members 1, 2 and the armature 7 are positioned on a front of the coil 18 perpendicular to a center axis of the coil 18. The core arms 3, 4 of the core yoke members 1, 2 are located largely within the coil 18. Electrical coil terminals 27 that are electrically connected to the coil 18 extend from the coil 18.

Figure 9:
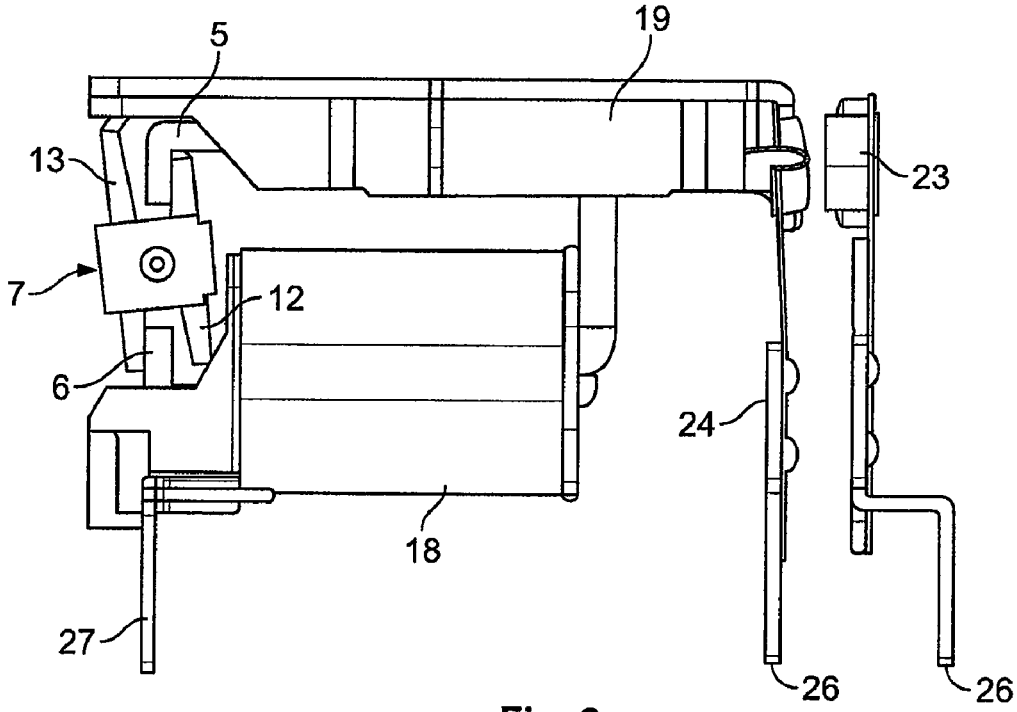
FIG. 9 is a diagrammatic side view of a portion of the bi-stable relay containing the core structure of FIG. 3.

FIGS. 6-7 and 9 show the bi-stable relay containing the core structure according to the invention. As shown in FIGS. 6-7, the relay consists of the body 21. The body 21 is formed, for example, of an insulating material and defined a substantially flat bottom surface (datum plane) 22. Electrical terminals 26 and the electrical coil terminals 27 extend from the bottom surface 22. The body 21 has a plurality of raised lateral walls and transverse walls that define a substantially flat, basin-shaped recess and individual contact carrier chambers for a contact system. The contact system consists of a fixed contact carrier 23 and a moveable contact carrier 24. The moveable contact carrier 24 is substantially horizontally displaceable and can be moved by a substantially comb-shaped slider 19 positioned substantially parallel to the bottom surface 22. At an end opposite from the contact system, the slider 19 is provided with a recess 25 that receives the armature projection 20 in a position away from the coil 18. The armature projection 20 engages in the recess 25 to form an integral member consisting of the armature core arm 13 and the slider 19. It will be appreciated by those skilled in the art that the contact system is not limited to the embodiment described herein and that more complicated contact systems, for example the contact system described in DE 198 47 831 A1 may be used.

Both sides of the armature 7 are supported via the stub axles 15 on bearings on the body 21 such that the armature 7 can rotate on the bearings. The rotation of the armature 7 is limited by a stop at the free ends of the yoke arms 5, 6 of the first and second core yoke members 1, 2. Since the armature core arms 12, 13 extend beyond the air gap 16 on the sides of the free ends of the opposite yoke arms 5, 6, the interaction of the permanent magnet 14 and the pole faces 10, 11, whose polarity depends on the polarity of the coil 18, causes an upper end of the armature core arm 12 to strike the yoke arm 5 of the core yoke member 1 and at the same time a lower end of the armature core arm 13 to strike the yoke arm 6 of the second core yoke member 2, as shown in FIGS. 3, and 8-9. This position will be referred to herein as a first switch position of the armature 7, which corresponds to a first polarity state of the coil 18. Thus, a horizontally positioned magnet system with the armature 7 having a substantially H-shape offers the possibility of horizontal armature movement.

In a second switch position, which corresponds to a second or reversed polarity state of the coil 18, an upper end of the armature core arm 13 strikes the yoke arm 5 of the core yoke member 1 and at the same time a bottom end of the armature core arm 12 strikes the yoke arm 6 of the second core yoke member 2. As the armature core arm 13 changes between the first and second switch positions, the armature projection 20 moves the slider 19 substantially parallel to a center axis of the coil. As the slider 19 is moved between the first and second switch positions, the slider 19 moves the moveable contact carrier 24 into an open or closed switch position with the fixed contact carrier 23. After switching the magnet system from either the first switch position to the second switch position or vice versa, the voltage of the coil 18 can be stopped, as the switch position assumed can then be held by the permanent magnet 14, until the coil 18 is magnetized in the opposite direction.

In the magnet system according to the invention, since both the slider 19 and the coil 18, are positioned substantially parallel to the bottom surface 22 of the relay, the relay can be formed with a low overall height of about 16 mm. Additionally, because the magnet system is pole reversible, a force may be applied in the first and second switch directions so that any electrically induced welds in the contact system of the relay, which may occur during the life of the relay, can be broken.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A magnet system for a bi-stable relay, comprising:

a coil having a first polarity state and a second polarity state;

first and second core yoke members, each of the first and second core yoke members having a core arm and a yoke arm, each of the yoke arms of the first and second core yoke members having a pole face; and an armature having substantially parallel armature core arms separated by a permanent magnet, the armature being pivotally mounted in an air gap between the pole faces of the yoke arms of the first and second core yoke members such that the armature core arms contact the yoke arms of the first and second core yoke members in a first switch position corresponding to the first polarity state and in a second switch position corresponding to the second polarity state, the armature core arms being arranged substantially perpendicular to a center axis of the coil;

wherein at least one of the armature core arms has a projection that engages with a slider.

2. The magnet system of claim 1, wherein the armature has a substantially H-shape.

3. The magnet system of claim 1, wherein the first core yoke member is substantially U-shaped and the second core yoke member is substantially L-shaped.

4. The magnet system of claim 1, wherein the yoke arm of the first core yoke member is substantially U-shaped and the yoke arm of the second core yoke member is substantially straight.

5. The magnet system of claim 1, wherein each of the yoke arms of the first and second core yoke members has an end section near the pole face with an enlarged cross-section.

6. The magnet system of claim 1, wherein the slider moves substantially parallel to the center axis of the coil in response to movement of the armature.

7. The magnet system of claim 1, wherein an extrusion coating is provided about a substantially center of the armature.

8. The magnet system of claim 7, wherein at least one stub axle is provided in the extrusion coating.

9. A bi-stable relay, comprising:

an insulating body having a bottom surface and a recess;

a coil having a first polarity state and a second polarity state, the coil being arranged in the recess such that a center axis of the coil is arranged substantially parallel to the bottom surface;

first and second core yoke members, each of the first and second core yoke members having a core arm and a yoke arm, each of the yoke arms having a pole face; and an armature having substantially parallel armature core arms separated by a permanent magnet, the armature being pivotally mounted in an air gap between the pole faces of the yoke arms of the first and second core yoke members such that the armature core arms contact the yoke arms of the first and second core yoke members in a first switch position corresponding to the first polarity state and in a second switch position corresponding to the second polarity state;

wherein at least one of the armature core arms has a projection that engages with a slider.

10. The bi-stable relay of claim 9, wherein the armature core arms are arranged substantially perpendicular to a center axis of the coil.

11. The bi-stable relay of claim 9, wherein the armature has a substantially H-shape.

12. The bi-stable relay of claim 9, wherein the first core yoke member is substantially U-shaped and the second core yoke member is substantially L-shaped.

13. The bi-stable relay of claim 9, wherein the yoke arm of the first core yoke member is substantially U-shaped and the yoke arm of the second core yoke member is substantially straight.

14. The bi-stable relay of claim 9, wherein each of the yoke arms of the first and second core yoke members has an end section near the pole face with an enlarged cross-section.

15. The bi-stable relay of claim 9, wherein the slider moves substantially parallel to the center axis of the coil in response to movement of the armature.

16. The bi-stable relay of claim 9, wherein the armature is pivotally mounted to the body.

17. The bi-stable relay of claim 16, wherein the armature has at least one stub axle that pivotally mounts the armature to the body.

18. The bi-stable relay of claim 17, wherein the stub axle is provided in an extrusion coating provided about a substantial center of the armature.

* * * * *